US006823531B1

(12) United States Patent
Chen

(10) Patent No.: US 6,823,531 B1
(45) Date of Patent: Nov. 30, 2004

(54) HELMET WITH VENTILATION

(76) Inventor: Jeremy Chen, No. 12-2, Alley 2, Hu-Tzu Rd., Hu-Pei Village, Lin-Kou Hsianq, Taipei Hsien (TW)

( * ) Notice: Subject to any disclaimer, the term of this patent is extended or adjusted under 35 U.S.C. 154(b) by 0 days.

(21) Appl. No.: 10/736,564

(22) Filed: Dec. 17, 2003

(51) Int. Cl.[7] ..... A42C 5/04
(52) U.S. Cl. ..... 2/171.3; 2/424
(58) Field of Search ..... 2/410, 424, 411, 2/425, 171.3, 171.4, 414

(56) References Cited

U.S. PATENT DOCUMENTS

| | | | | | |
|---|---|---|---|---|---|
| 4,081,865 | A | * | 4/1978 | Bergee et al. | 2/425 |
| 4,115,874 | A | * | 9/1978 | Hasegawa | 2/425 |
| 4,519,099 | A | * | 5/1985 | Kamiya et al. | 2/424 |
| 5,345,614 | A | * | 9/1994 | Tanaka | 2/425 |
| 5,867,840 | A | * | 2/1999 | Hirosawa et al. | 2/414 |
| 5,915,537 | A | * | 6/1999 | Dallas et al. | 2/410 |
| 6,105,172 | A | * | 8/2000 | Shida | 2/171.3 |
| 6,170,090 | B1 | * | 1/2001 | Minor | 2/411 |
| 6,263,513 | B1 | * | 7/2001 | Murakami | 2/171.3 |

FOREIGN PATENT DOCUMENTS

| | | | | |
|---|---|---|---|---|
| GB | 2075820 A | * | 11/1981 | A42B/3/00 |
| JP | 06041807 A | * | 2/1994 | A42B/3/28 |
| WO | WO 9105489 A1 | * | 5/1991 | A42B/3/12 |

* cited by examiner

*Primary Examiner*—Rodney M. Lindsey
(74) *Attorney, Agent, or Firm*—Dennison, Schultz, Dougherty & MacDonald

(57) ABSTRACT

A helmet with ventilation having at its front bubble provided with multiple slot air inlets; a circular air passage connected through those slot air inlets being provided to the peripheral of an inner lining adapted to the bubble; multiple expel holes connected through the interior of the helmet being provided to the air passage; an air outlet being provided on the rear of the bubble of the helmet; an air inlet lid being covered up those slot air inlets; and an air inlet gate allowing free elevation being provided at where between the air inlet lid and those slot air inlets.

2 Claims, 6 Drawing Sheets

HELMET WITH VENTILATION

BACKGROUND OF THE INVENTION (a) Field of the Invention

The present invention is related to a helmet with ventilation, and more particularly to one that expels the hot air inside the helmet to admit fresh air into the helmet for the comfort of its wearer.

(b) Description of the Prior Art

Either the full or the half bubble, two air inlets 101 are provided at the bubble 10 of the helmet as illustrated in FIG. 10 of the accompanying drawings, a lid 102 allowing free lateral movement is each provided to open up or close up the air inlets 101, and two through holes respectively aligned to those two air inlets 101 are provided in front of the inner lining of the helmet to admit the cooler air into the helmet through the air inlets 101 and the through holes against the wind while the wearer is riding his/her motorcycle.

However, the amount of air admitted through both air inlets 101 is very limited, and the through holes inside the helmet is located at where close to the forehead of the rider, so that once the inner wall of the helmet is further covered by a layer of sponge, those air inlets 101 and through holes fail to sufficiently expel the hotter air inside the helmet or supply enough cooler air to the peripheral of the head of the rider. The rider still feels uncomfortable due to the stagnation of hotter air inside the helmet.

SUMMARY OF THE INVENTION

The primary purpose of the present invention is to provide a helmet with ventilation to allow massive hotter air expel and cooler air admission. To achieve the purpose, a slot type of air inlet allowing free control of massive air inlet amount is provided on the bubble of the helmet, and passage is provided in the lining of the helmet.

Wherein, multiple slot air inlets are provided on the bubble of the helmet at where close to the forehead of a rider, and connected through a circular air passage provided to the peripheral of the lining of the helmet; multiple air expel holes connecting through the interior of the helmet are provided to the air passage; an air outlet is provided on the rear of the bubble of the helmet; an air inlet lid is provided to cover the air inlets, and an air inlet gate allowing free elevation is provided between the air inlet lid and the air inlets.

Another purpose of the present invention is to provide a helmet with ventilation that is adaptable to a full or half bubble type of a helmet.

DETAILED DESCRIPTION OF THE PREFERRED EMBODIMENT

Figure 1:
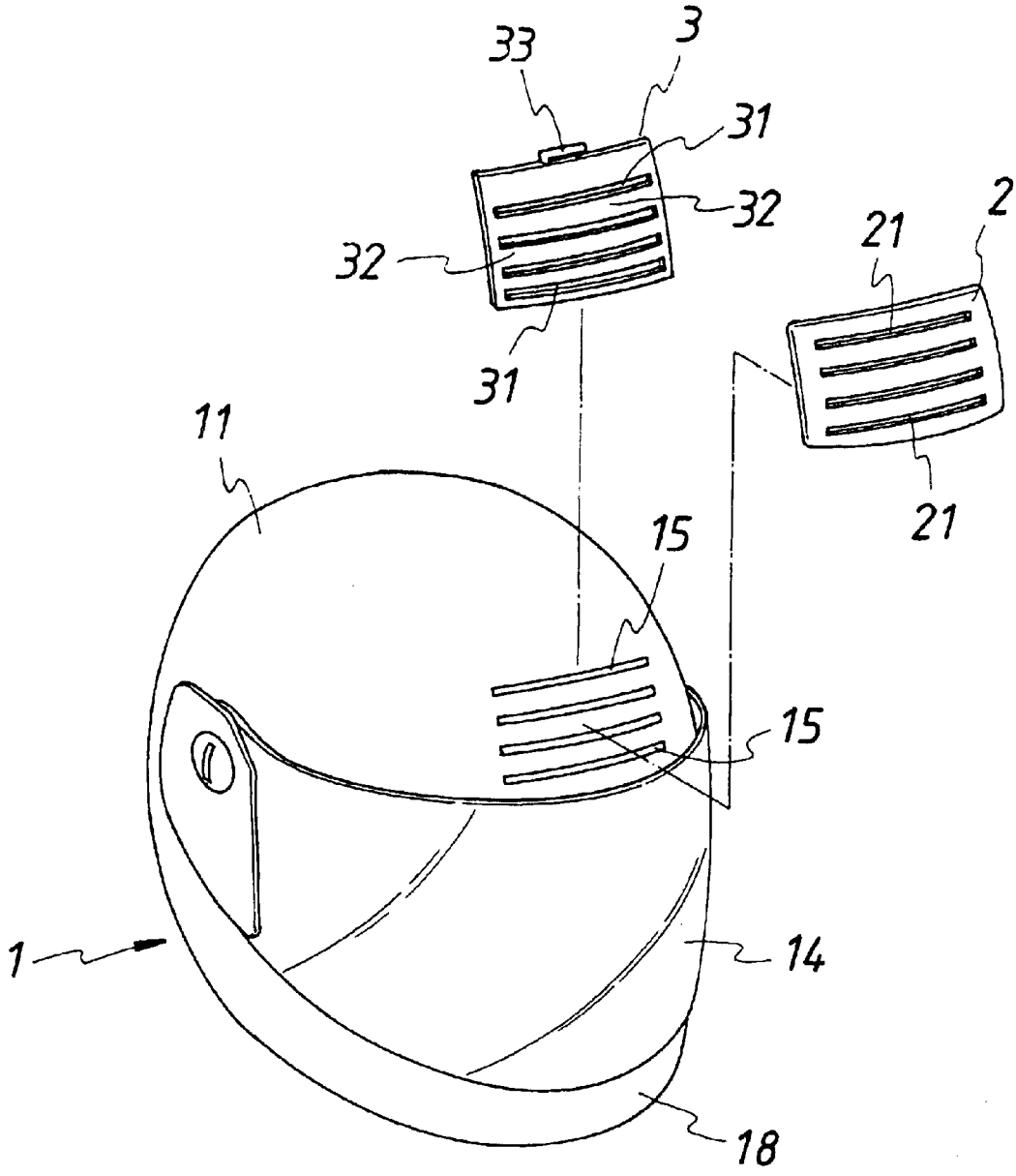
FIG. 1 is an exploded view of a preferred embodiment of the present invention applied to a full bubble type of helmet.
Figure 2:
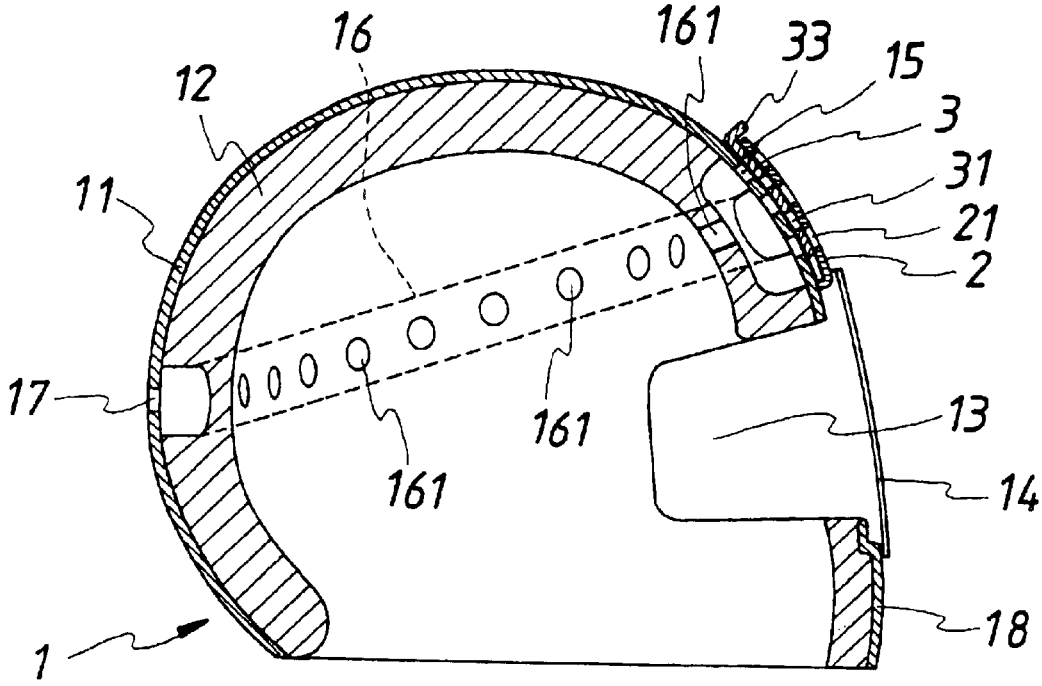
FIG. 2 is a sectional view of the preferred embodiment of the present invention applied to a full bubble type of helmet.

The present invention is related to a helmet with ventilation essentially comprised of a helmet 1, an air inlet lid 2 and an air inlet gate 3. Wherein, as illustrated in FIGS. 1 and 2, the helmet 1 includes a full bubble 11 and an inner lining 12. A window 13 is provided on the front of the bubble, a front guard strip 18 is provided at the lower end of the window 13, and an arc visor 14 permitting free lift as desired is hinged to the window 13. In a preferred embodiment of the present invention, multiple slot air inlets 15 are provided at where selected on the front bubble 11 close to the forehead of the rider, a circular air passage 16 is provided to the peripheral of the inner lining 12 and the front of the circular air passage 16 is connected through those air inlets 15. Multiple air expel holes 161 are provided to the air passage 16 that are connected through the interior of the helmet, and an air outlet 17 is provided on the rear of the bubble 11 to connect through the rear end of the circular air passage 16 so to admit the cooler air outside the helmet to flow through those slot air inlets 15, the air passage 16 and those air expel holes 161 into the interior of the helmet while the hotter air inside the helmet flows through those air expel holes 161, the air passage 16 and the air outlet 17 into the air.

The air inlet lid 2 made in a "[]" shape as illustrated in FIG. 1 is provide to cover up those slot air inlets 15 on the front bubble 11 of the helmet and multiple slot ventilation holes 21 are provided on the surface of the air inlet lid 2 with its upper edge as an open end to be inserted with the air inlet gate 3.

The air inlet gate 3 as illustrated in FIG. 1 is provided for the control of the opening or shutting of those slot air inlets 15 on the bubble 11 of the helmet. Multiple slot ventilation holes 31 are provided on the air inlet gate 3 to define a retainer 32 between any two abutted slot ventilation holes 31, and a dialer 33 is provided at the top of the air inlet gate 3.

Figure 3:
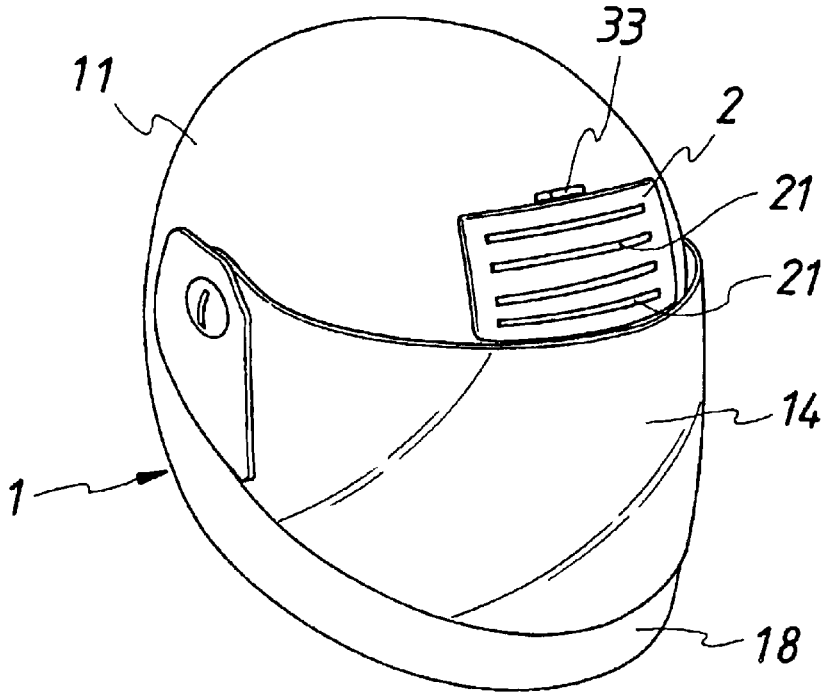
FIG. 3 is a perspective view of the preferred embodiment of the present invention applied to a full bubble type of helmet.

When assembled as illustrated in FIGS. 2 and 3, the air inlet lid 2 covers and is secured on the outside of those slot air inlets 15 on the bubble 11 of the helmet while the air inlet gate 3 is inserted from the top of the air inlet lid 2 into where between the air inlet lid 2 and those slot air inlets 15 on the bubble 11 of the helmet for the air inlet gate 3 to control the opening or shutting of those slot air inlets 15. Consequently, the cooler air is admitted through the air inlet lid 2, the air inlet gate 3, those slot air inlets 15 and the air passage 16 into the helmet, and the hotter air inside the helmet is expelled from the air outlet 17 at the rear of the bubble 11 of the helmet.

Figure 4:
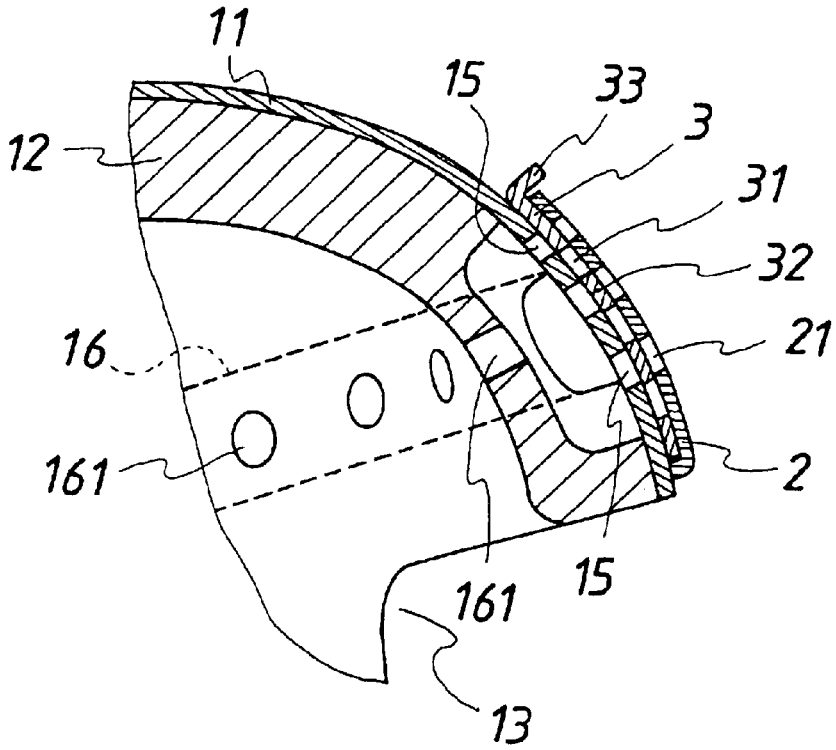
FIG. 4 is a schematic view showing that an air inlet gate of the preferred embodiment of the present invention is closed up.
Figure 5:
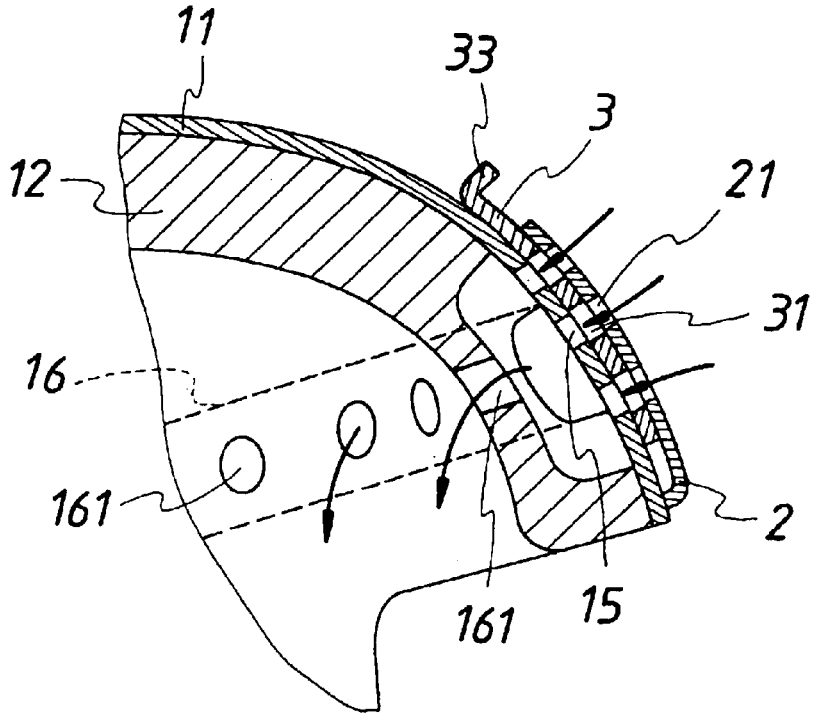
FIG. 5 is a schematic view showing that the air inlet gate of the preferred embodiment of the present invention is opened up.

The rider may decide whether to admit the cooler air into the helmet. In case of a bitter cold or the air quality is poor, the rider may press down the air inlet gate 3 as illustrated in FIG. 4 for the retainers 32 to stop or cover up the air at where between those slot air inlets 15 on the bubble 11 and those slot ventilation holes 21 on the air inlet lid 2 so to prevent the cold air or contaminated air from entering into the helmet while the hotter air remains to be expelled into the air through those air expel holes 161, the air passage 16 and the air outlet 17 at the rear of the bubble 11 of the helmet. If the cooler air is desired to be admitted into the helmet, the air inlet gate 3 is lifted up for those retainers 32 to depart from where between those slot air inlets 15 and those slot ventilation holes 21 as illustrated in FIG. 5, so that by taking advantage of being against the wind while riding, the air outside the helmet is admitted into the helmet through those slot ventilation holes 21, 31, those slot air inlets 15, the air passage 16 and those air expel holes 161 while the hotter air remains to be expelled into the air through those air expel holes 161, the air passage 16 and the air outlet 17 at the rear of the bubble 11 of the helmet.

The present invention allows the control whether to admit massive air into the helmet or not, thus to provide the optimal comforts to the rider. When the air is not permitted to enter into the helmet, the hotter air remains to be expelled out of the helmet. The design of the circular air passage 16 not only retains the structural strength of the helmet but also provides the balanced benefits of wearing comforts and safety of the helmet.

Figure 6:
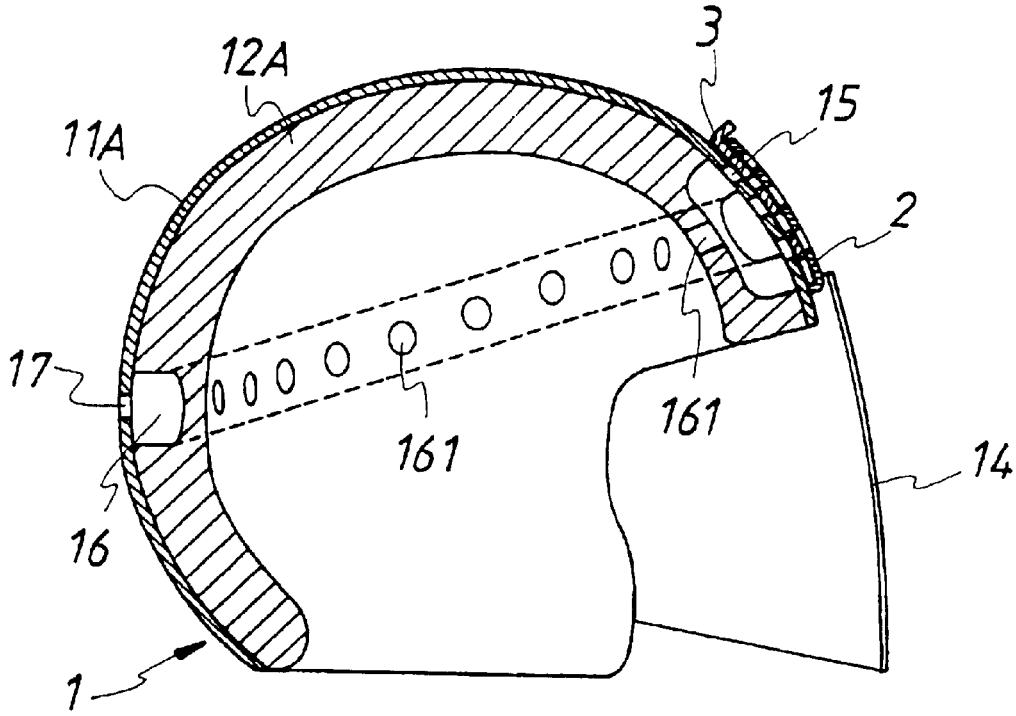
FIG. 6 is a sectional view of another preferred embodiment of the present invention applied to a full bubble type of helmet.
Figure 7:
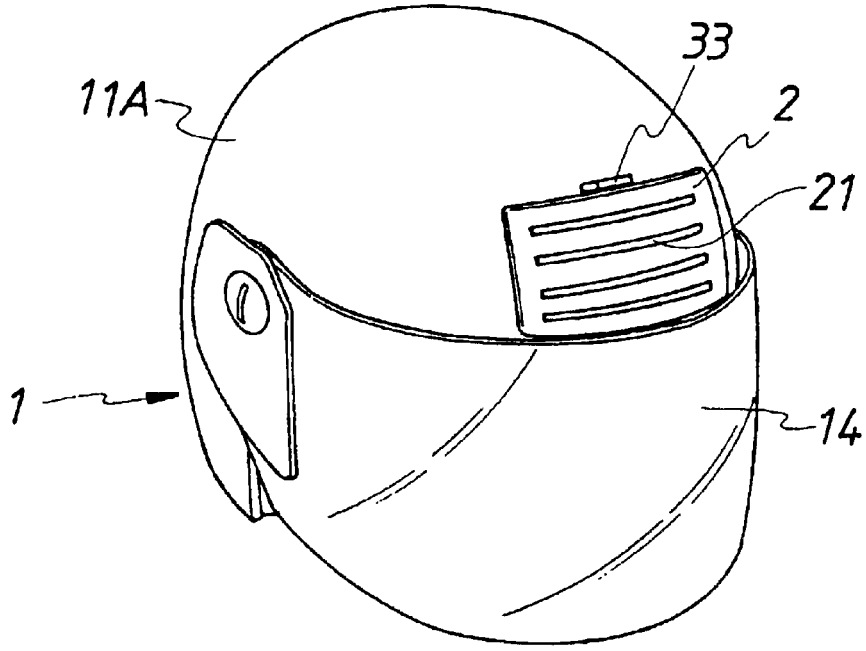
FIG. 7 is a perspective view of another preferred embodiment of the present invention applied to a full bubble type of helmet.
Figure 8:
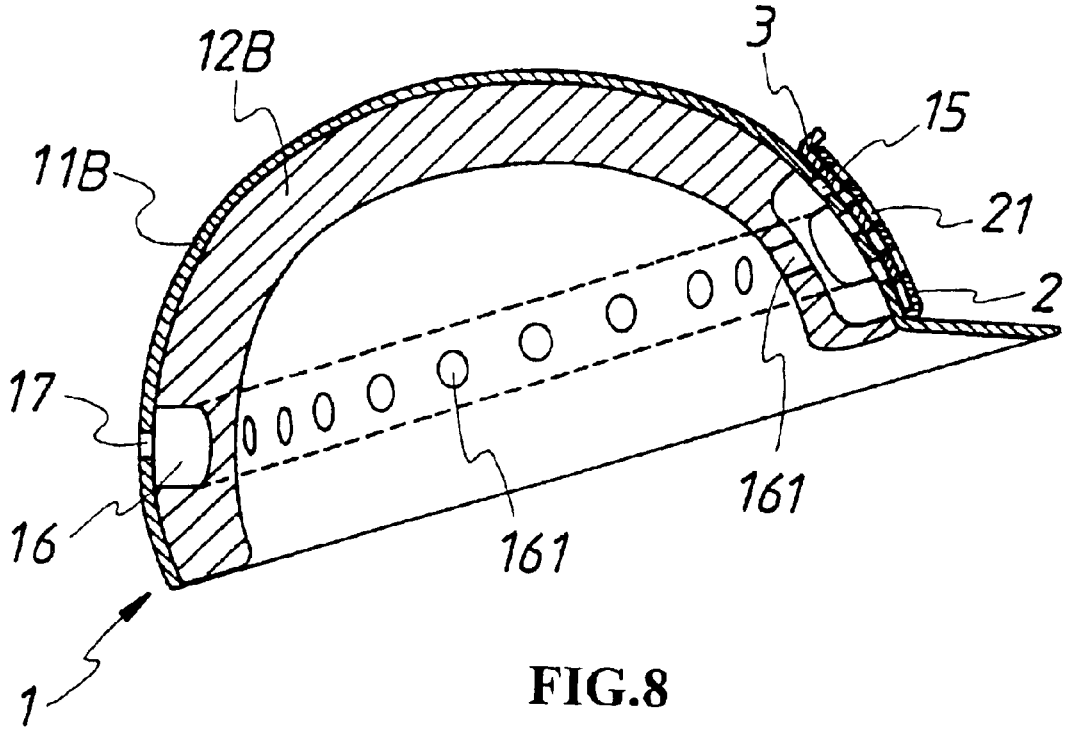
FIG. 8 is a sectional view of a preferred embodiment of the present invention applied to a half bubble type of helmet.
Figure 9:
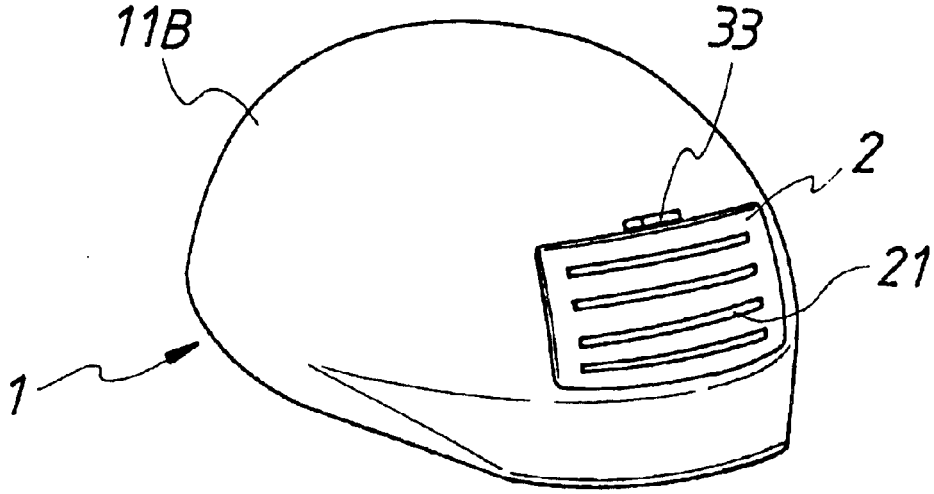
FIG. 9 is a perspective view of the preferred embodiment of the present invention applied to a half bubble type of helmet.
Figure 10:
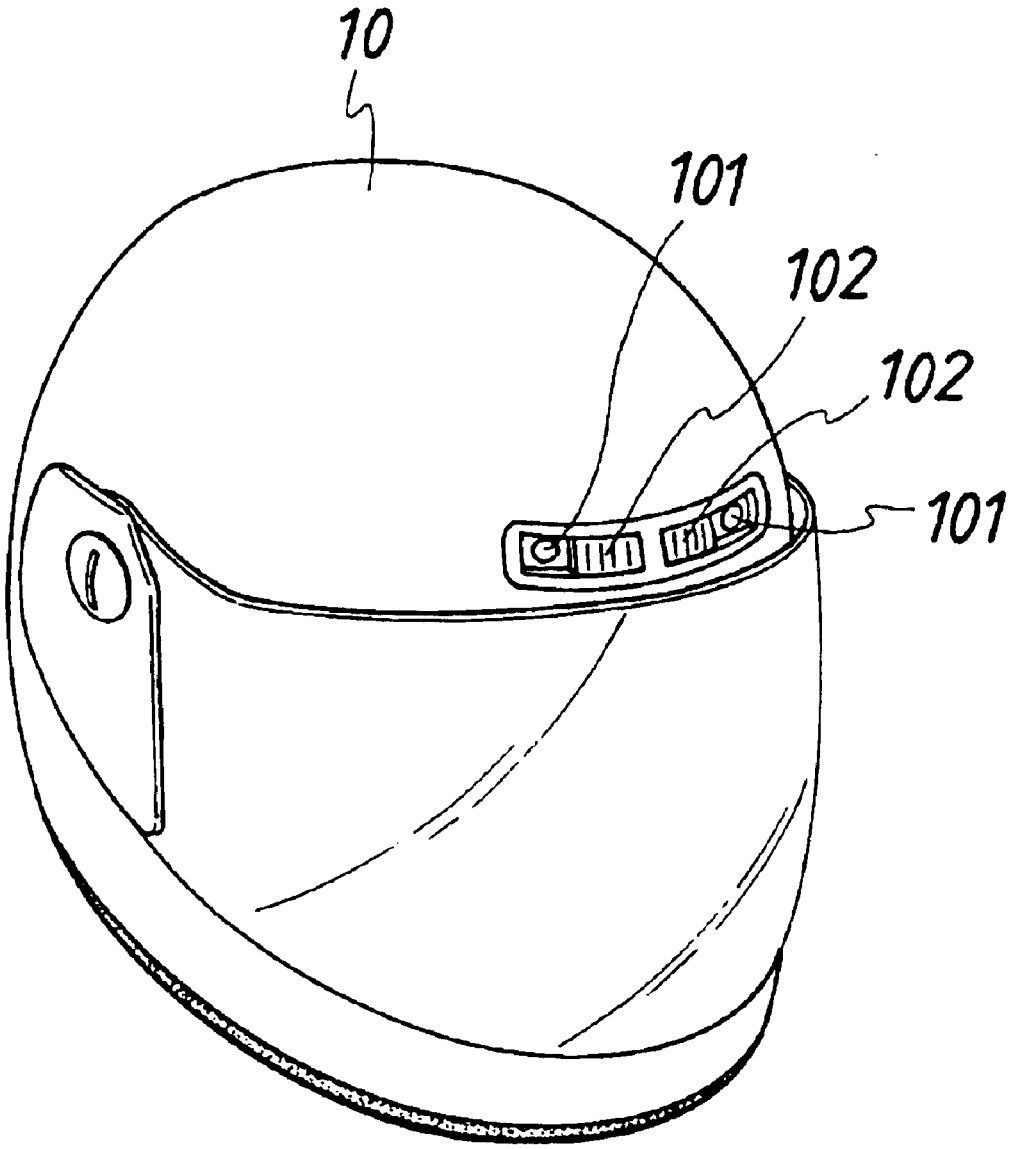
FIG.10 PRIOR ART
FIG. 10 is a schematic view showing a ventilation structure of the prior art of the present invention.

It should be noted that in the present invention, the helmet 1 is not limited to the full bubble 11, i.e. a bubble provided with a front guard strip 18 and an inner lining 12; it can be also related to a full bubble 11A adapted with an inner lining 12A without the front guard strip 18 as illustrated in FIGS. 6 and 7, or related to a half bubble 11B adapted with an inner lining 12B as illustrated in FIGS. 8 and 9 characterized by the same multiple slot air inlets 15, the air passage 16, multiple air expel holes 161, the air outlet 17, the air inlet lid 2 and the air inlet gate 3. Furthermore, those slot air inlets 15, and those slot ventilation holes 21, 31 are not limited to the shape of slot; and they may be provided in the form of multiple round holes or holes in any other shape for the assembly of a helmet provided with ventilation to achieve the optimal ventilation and comforts for the rider.

What is claimed is:

1. A helmet with ventilation essentially comprised of a helmet comprised of a bubble adapted with an inner lining, an air inlet lid and an air inlet gate is characterized by that multiple slot air inlets being provided on the front bubble of the helmet close to the forehead of a rider; a circular air passage being provided to the peripheral of the inner lining; the circular air passage being connected through those air inlets; multiple air expel holes connecting through the inner space of the inner lining being provided to the air passage; and an air outlet connected through the circular air passage being provided on the rear of the bubble; the air inlet lid being provided on the bubble of the helmet to cover up the outside of those slot air inlets; multiple slot ventilation holes being provided on the surface of the air inlet lid with an opening end provided for the insertion of the air inlet gate; the air inlet gate being inserted between the air inlet lid and those slot air inlets on the bubble of the helmet; multiple slot ventilation holes being provided on the surface of the air inlet gate to define a retainer between any two abutted slot ventilation holes; the air inlet gate being provided to control the opening or shutting of those slot air inlets; the cooler air outside being admitted through the air inlet lid, the air inlet gate, multiple slot air inlets and the air passage into the helmet and the hotter air in the helmet being expelled through the air outlet provided on the rear of the bubble of the helmet.

2. A helmet with ventilation as claimed in claim 1, wherein, a dialer is provided to either end of the air inlet gate.

* * * * *